United States Patent [19]

Grillo et al.

[11] 4,135,829

[45] Jan. 23, 1979

[54] HOMOGENIZER

[75] Inventors: Richard J. Grillo; Carmine T. Castellano, both of White Plains, N.Y.

[73] Assignee: International Telephone and Telegraph Corporation, Nutley, N.J.

[21] Appl. No.: 827,199

[22] Filed: Aug. 24, 1977

[51] Int. Cl.[2] ..... B01F 15/00

[52] U.S. Cl. ..... 366/337; 138/42

[58] Field of Search ..... 366/124, 336, 337, 338; 426/519; 137/54, 809, 819; 138/42, 43

[56] References Cited

U.S. PATENT DOCUMENTS

| | | | |
|---|---|---|---|
| 2,304,689 | 12/1942 | Hanson | 138/42 |
| 2,914,086 | 11/1959 | Beller | 251/30 X |
| 3,167,305 | 1/1965 | Backx et al. | 138/42 X |
| 3,744,762 | 7/1973 | Schlicht | 366/336 |

*Primary Examiner*—Leonard D. Christian

*Attorney, Agent, or Firm*—John T. O'Halloran; Alfred C. Hill

[57] ABSTRACT

A plurality of identical cell rupture valve assemblies are connected in tandem to produce increased homogenization effectiveness.

6 Claims, 8 Drawing Figures

HOMOGENIZER

BACKGROUND OF THE INVENTION

This invention relates to two stage homogenizers, and more particularly to homogenizers having a two stage cell rupture valve assembly.

A process to produce an egg yolk replacer emulsion, developed by Dr. C. T. Tan, G. P. Pulver and E. W. Turner at ITT Continental Baking Company disclosed in copending application Ser. No. 682,298, filed May 3, 1976, requires four homogenization passes through a two stage Gaulin homogenizer. A cell rupture valve is used in only the first stage of this homogenizer. The second stage consists of a valve similar to a flat plug valve. The second stage valve controls back pressure and concentrates the energy in the first stage homogenizing zone. The second stage valve does not aid in the actual homogenization process and is therefore designed to be a much less effective valve than the first stage cell rupture valve.

SUMMARY OF THE INVENTION

An object of the present invention is the provision of an improved two stage homogenizer.

A feature of the present invention is the provision of a homogenizer comprising: a plurality of identical cell rupture valve assemblies connected in tandem to produce increased homogenization effectiveness.

Another feature of the present invention is the provision of a method of producing increased homogenization effectiveness comprising the steps of, introducing a product to be homogenized to a valve seat of a first cell rupture valve assembly; removing the homogenized product from the output of the valve seat of the first valve assembly; introducing the homogenized product to a valve seat of a second cell rupture valve assembly; and removing the homogenized product from the output of the valve seat of the second valve assembly.

The two stage cell rupture valve assembly homogenizer of the present invention was originally conceived to reduce the number of homogenization passes required to produce an acceptable egg yolk replacer emulsion.

By increasing the effectiveness of the various processing steps in Dr. Tan's, Ms. Pulver's and Dr. Turner's process and by using a single cell rupture valve assembly it was possible to produce an acceptable egg yolk replacer emulsion using only one homogenization pass.

By utilizing a two stage cell rupture valve assembly only one homogenization pass was required to produce a product with a high degree of protein solubility and functionality.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
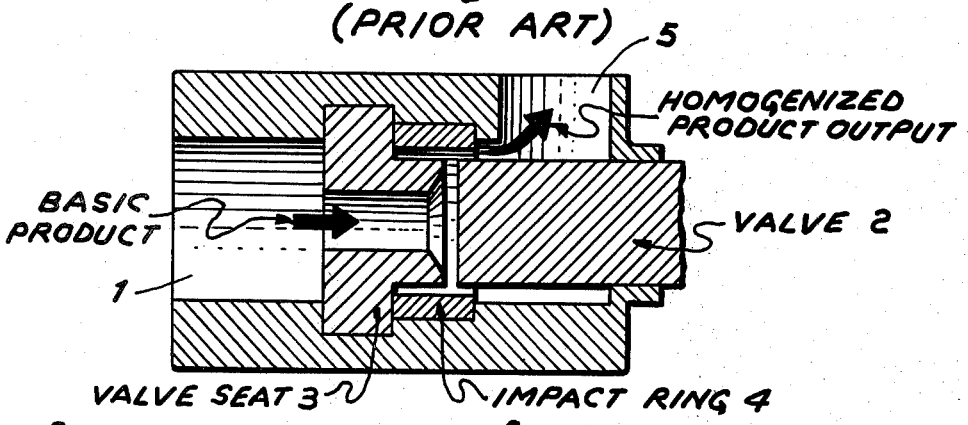
Fig. 1 (PRIOR ART)
FIG. 1 is a cross-sectional view of a prior art homogenizer employed to explain the principles of the operation of a homogenizer valve assembly.

Most homogenizer valve assemblies operate under the same prinicples as depicted in FIG. 1. The product enters the valve area 1 at a high pressure, thus forcing adjustable valve 2 from valve seat 3. By decreasing the distance of valve 2 from the valve seat 3 the pressure is increased and visa versa. As the product passes through the aperture between valve 2 and valve seat 3, an instantaneous pressure drop to less than atmospheric pressure occurs, causing a shearing action and cavitation bubbles. The product then strikes the impact ring 4 at a velocity of approximately 50,000 feet per minute, further shattering the particles by impact and implosion of the bubbles. The homogenized product then exits the homogenizer at output cavity 5, or in the case of a two stage assembly, continues to the next stage where the whole operation is repeated.

Figure 2:
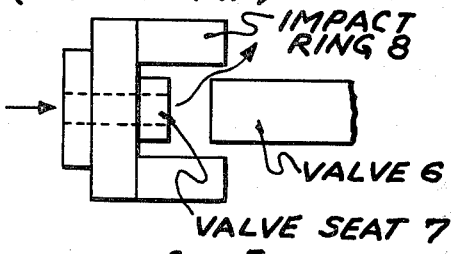
Fig. 2 (PRIOR ART)
FIG. 2 is a schematic illustration of a flat plug valve assembly homogenizer in its fully opened position.
Figure 3:
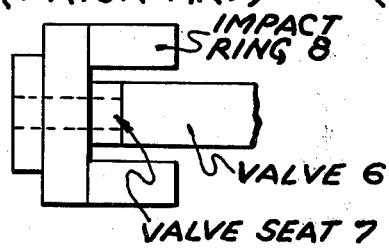
Fig. 3 (PRIOR ART)
FIG. 3 is a schematic illustration of the flat plug valve assembly homogenizer of FIG. 2 in its fully closed position.

Referring to FIGS. 2 and 3 a typical flat plug homogenizer valve assembly is shown. When the flat plug valve 6 is fully closed it sits flush against the valve seat 7. The valve assemblies of FIGS. 2 and 3 also include as an integral part thereof the impact ring 8.

Figure 5:
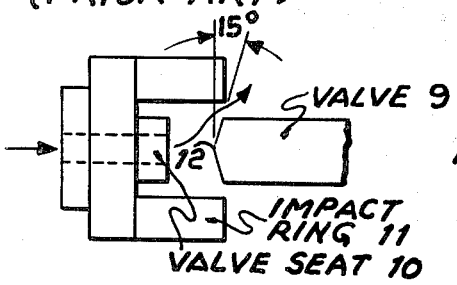
Fig. 5 (PRIOR ART)
FIG. 5 is a schematic illustration of a cell rupture valve assembly in its fully opened position.
Figure 6:
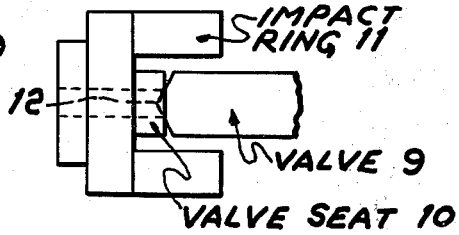
Fig. 6 (PRIOR ART)
FIG. 6 is a schematic illustration of the cell rupture valve assembly of FIG. 5 in its fully closed position.

A cell rupture valve assembly is illustrated in FIGS. 5 and 6. This valve assembly also includes a valve 9, a valve seat 10 and an impact ring 11. This valve assembly works on the same basic principles as the flat plug valve assembly of FIGS. 2 and 3 except it has a 15° conical tip 12 which extends into valve seat 10 when fully closed.

Figure 8:
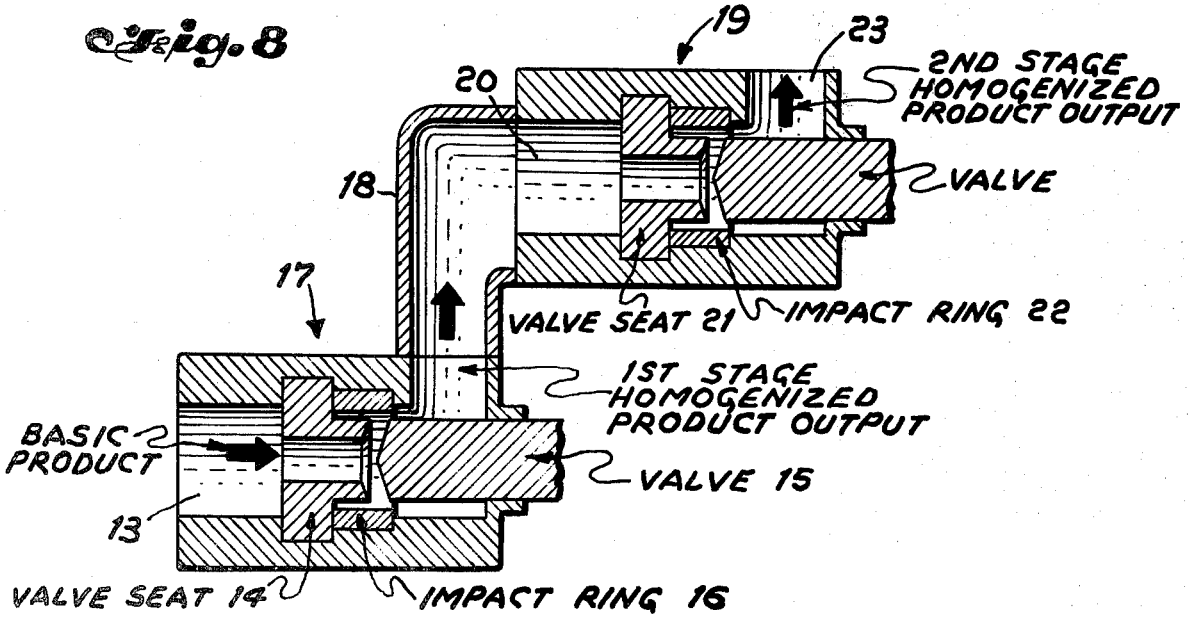
FIG. 8 is a cross-sectional view of the two stage homogenizer in accordance with the principles of the present invention.

Referring to FIG. 8, there is illustrated therein a cross-sectional view of a two stage cell rupture valve assembly which includes a basic product input 13. The product passes through a valve seat 14 when valve 15 is in its open position. As explained with respect to FIG. 1 the product is at a high pressure forcing valve 15 to its open position to provide a portion of the homogenization and strikes impact ring 16 to further increase the homogenization. The output of the first stage 17 is connected by a connection 18 to a second stage cell rupture valve assembly 19 which includes an input 20 to receive the first stage homogenized product which is then passed through valve seat 21 to produce further homogenization as explained with respect to FIG. 1 and then strikes an impact ring 22 which further homogenizes the product applied to the original input 13. The second stage homogenized product output is taken from cavity 23.

By making the second stage of a two stage homogenizer identical to the first stage and having both stages as cell rupture valve assemblies, it is possible to reduce the number of homogenization passes and still produce a product of high protein solubility and functionality.

Figure 4:
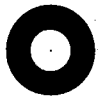
Fig. 4 (PRIOR ART)
FIG. 4 is a view of the cross-sectional area over which homogenization pressure is exerted in the flat plug valve assembly of FIGS. 2 and 3.
Figure 7:
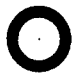
Fig. 7 (PRIOR ART)
FIG. 7 is a view of the cross-sectional area over which homogenization pressure is exerted in the cell rupture valve assembly of FIGS. 5 and 6.

The cell rupture valve assembly is more effective then a typical flat plug valve assembly because: (1) the cross-sectional area over which the actual pressure is exerted is two to three times less then with a flat plug valve as illustrated in FIGS. 4 and 7; and (2) the frequency of oscillation is more then double that of the flat plug valve assembly.

Total homogenization pressure as indicated by a pressure gauge may be identical when using flat plug or cell rupture valve assemblies. However, due to the reduced cross-sectional area over which homogenization occurs, the effective pressure is two to three times greater for the cell rupture valve then for the flat plug valve. The increased oscillation of the cell rupture valve results in greater interaction of the individual product particles with each other and the valve assembly.

Through the use of cell rupture valve assemblies for both stages of two stage homogenizers it is possible to produce an acceptable homogenized product using fewer passes then previously required with other types of valve assemblies.

The effectiveness of various valve assemblies was determined by the amount of soy protein isolate dissolved in water after one pass through a homogenizer. The valve assemblies for homogenizers listed in order of their effectiveness are: (1) a two stage cell rupture valve assembly; (2) a two stage valve assembly consisting of: a first stage cell rupture valve assembly and a second stage flat plug valve assembly; and (3) a two stage flat plug valve assembly.

The two stage cell rupture valve assembly of FIG. 8 can be used to homogenize ice cream toppings, salad dressings, yogurts, milk products, liquid egg products, imitation liquid milk and egg products, soups, syrups, sauces, protein solutions, sour cream, mayonnaise and any other liquid emulsions.

While we have described above the principles of our invention in connection with specific apparatus it is to be clearly understood that this description is made only by way of example and not as a limitation to the scope of our invention as set forth in the objects thereof and in the accompanying claims.

We claim:

1. A homogenizer having an increased homogenization effectiveness comprising:
- a first cell rupture valve assembly including
  - a first valve seat having an input to receive a product to be homogenized and an output,
  - a first valve disposed adjacent said output of said first valve seat cooperating with said first valve seat to partially homogenize said product, and
  - a first impact ring encircling said output of said first valve seat to homogenize said partially homogenized product; and
- a second cell rupture valve assembly including
  - a second valve seat having an input coupled to said first impact ring to receive said homogenized product from said first valve assembly and an output,
  - a second valve disposed adjacent said output of said second valve seat cooperating with said second valve seat to partially homogenize said received homogenized product,
  - a second impact ring encircling said output of said second valve seat to complete homogenization of said product, and
  - an output for said second valve assembly disposed adjacent said second impact ring to remove said homogenized product from said second valve assembly.

2. A homogenizer according to claim 1, wherein said first and second valves have a 15° conical tip which extends into an associated one of said first and second valve seats when fully closed.

3. A homogenizer according to claim 1, wherein said first and second valves have a conical tip which extends into an associated one of said first and second valve seats when fully closed.

4. A method of producing increased homogenization effectiveness comprises the steps of
- introducting a product to be homogenized to a valve seat of a first cell rupture valve assembly;
- removing said homogenized product from the output of said valve seat of said first valve assembly;
- introducing said homogenized product to a valve seat of a second cell rupture valve assembly; and
- removing said homogenized product from the output of said valve seat of said second valve assembly.

5. A method according to claim 4, wherein
- a valve associated with each of said first and second valve assemblies has a conical tip which extends into its associated valve seat when fully closed.

6. A method according to claim 4, wherein
- a valve associated with each of said first and second valve assemblies has a 15° conical tip which extends into its associated valve seat when fully closed.

* * * * *